US008622217B2

(12) United States Patent
Dunér et al.

(10) Patent No.: US 8,622,217 B2
(45) Date of Patent: Jan. 7, 2014

(54) DISPOSABLE CIGARETTE BUTT RECEIVING BAG

(75) Inventors: Ingela Dunér, Lidingö (SE); Rebecka Dahlén, Stockholm (SE); Stina Axelsson, Stockholm (SE)

(73) Assignee: Spinecore AB, Lidingö (SE)

( * ) Notice: Subject to any disclaimer, the term of this patent is extended or adjusted under 35 U.S.C. 154(b) by 0 days.

(21) Appl. No.: 13/577,551

(22) PCT Filed: Jan. 21, 2011

(86) PCT No.: PCT/SE2011/050066

§ 371 (c)(1), (2), (4) Date: Aug. 7, 2012

(87) PCT Pub. No.: WO2011/099920

PCT Pub. Date: Aug. 18, 2011

(65) Prior Publication Data

US 2012/0305433 A1 Dec. 6, 2012

(30) Foreign Application Priority Data

Feb. 9, 2010 (SE) ..... 1050129

(51) Int. Cl.
*B65D 73/00* (2006.01)

(52) U.S. Cl.
USPC ..... 206/496; 131/231; 131/236; 383/84; 493/210; 493/243

(58) Field of Classification Search
USPC ..... 206/37, 236, 242, 246, 496, 527; 131/231, 235.1, 236; 383/84, 109, 127; 428/40.1, 40.8; 493/186, 210, 217, 493/224, 243, 260, 267
See application file for complete search history.

(56) References Cited

U.S. PATENT DOCUMENTS 2,636,532 A * 4/1953 Putt ..... 206/496
2,720,903 A * 10/1955 Pickren ..... 206/496

(Continued)

FOREIGN PATENT DOCUMENTS

JP 11-196848 A 7/1999
JP 2003-219858 A 8/2003

OTHER PUBLICATIONS

International Search Report received for PCT Patent Application No. PCT/SE2011/050066, mailed on Apr. 26, 2011, 4 pages.

*Primary Examiner* — Luan K Bui
(74) *Attorney, Agent, or Firm* — Morrison & Foerster LLP

(57) ABSTRACT

The invention relates to a cigarette butt receiving bag of disposable type for receiving and extinguishing glowing cigarettes, which bag (1) comprises a forward sheet (2), a rearward sheet (4), which sheets are sealed to each other along their outer edges (6) leaving an edge portion unsealed so as to provide an opening (8) for receiving a cigarette butt (10), thereby forming a cigarette butt receiving compartment (12) between said forward and rearward sheets (2, 4), and comprising a fluid (14), which is disposed in two heat insulating volumes (16, 18) within the cigarette butt receiving compartment (12). A first heat insulating volume (16) is delimited by the forward sheet (2) and a forward inner layer material (20) which is sealed against the forward sheet (2). A second heat insulating volume (18) is delimited by the rearward sheet (4) and a rearward inner layer material (22) which is sealed against the rearward sheet (4). The invention also relates to a method of manufacturing a cigarette butt receiving bag of disposable type.

15 Claims, 7 Drawing Sheets

(56) References Cited

U.S. PATENT DOCUMENTS

| | | | | | |
|---|---|---|---|---|---|
| 2,887,218 | A * | 5/1959 | Kirby | 206/496 |
| 2,932,301 | A * | 4/1960 | Tabara | 206/496 |
| 2,990,100 | A * | 6/1961 | Randak | 206/496 |
| 3,372,724 | A * | 3/1968 | Rouse | 206/496 |
| 4,018,235 | A | 4/1977 | Smith | |
| 5,224,499 | A * | 7/1993 | Zayas | 131/231 |
| 8,037,889 | B2 * | 10/2011 | Tsai | 131/231 |
| 2010/0224514 | A1 * | 9/2010 | Urf et al. | 206/268 |

* cited by examiner

DISPOSABLE CIGARETTE BUTT RECEIVING BAG

CROSS REFERENCE TO RELATED APPLICATIONS

This is a U.S. National Phase patent application of PCT/SE2011/050066, filed Jan. 21, 2011, which claims priority to the Swedish Patent Application No. 1050129-4, filed Feb. 9, 2010, each of which is hereby incorporated by reference in the present disclosure in its entirety.

TECHNICAL FIELD

The present invention relates to a disposable cigarette butt receiving bag according to the preamble of claim 1 and a method of manufacturing a disposable cigarette butt receiving bag according to the preamble of claim 11.

After a cigarette has been used the remaining part of a cigarette, defined as a cigarette butt, is disposed as litter. Often there is no access to an ashtray for extinguishing and disposal of the cigarette butt. As a consequence cigarette butts are often thrown on the ground.

BACKGROUND ART

Cigarette butts which are thrown on the ground constitute a substantial littering problem. The cigarette butts contain substances that are hazardous to the environment, and they also cause aesthetically unpleasant surroundings and consequently considerable sanitation costs. Further, when disposed of in the open, health-impairing cigarette butts are accessible to children and animals. Also, a glowing cigarette butt may set fire to inflammable material when thrown on the ground, floor or in a bin.

A bag-like portable ashtray is known from JP2003219858. The ashtray comprises an inner bag and an outer bag. A heat insulator is disposed between the inner and the outer bag. The heat insulator consists of a heat insulating material, such as a polymer absorbent in a porous material, which is closed in a separate bag.

One objective problem to be solved by the present invention is to prevent pollution of the environment due to cigarette butts thrown on the ground.

Another objective problem to be solved by the present invention is to avoid that cigarette butts are accessible to children and animals.

A further problem to be solved by the present invention is to increase safety to fire due to disposed glowing cigarette butts.

A further problem to be solved by the present invention is to achieve a cost effective handling of a large number of disposed cigarette butts.

SUMMARY OF THE INVENTION

These objective problems are solved by a disposable cigarette butt receiving bag according to claim 1.

Such a disposable cigarette butt receiving bag prevents pollution of the environment due to cigarette butts thrown on the ground. The butt receiving bag is easy to keep and store into a pocket or a handbag and after the butt has been introduced into the butt receiving bag it may be disposed into a refuse bin or put back into the pocket or the handbag and disposed later.

According to an embodiment the invention one of the forward or rearward sheets is provided with a foldable closure flap extending from the edge of the opening, and where a pressure sensitive adhesive is arranged along the entire width of the flap to ensure tight sealing of the bag. Since the closure flap seals the butt receiving bag after the cigarette butt has been introduced into the butt receiving bag the cigarette butt is not accessible to children and animals. Also, there is no leakage of hazardous chemicals or substances. In this sense the disposable cigarette butt receiving bag will be made more child proof and animal proof.

According to a further embodiment of the invention the width of the forward inner layer material and the width of the rearward inner layer material between two longitudinal edges of the respective forward and rearward inner layer material together substantially correspond to a circumference of the cigarette butt. This will increase safety to fire due to disposed glowing cigarette butts, since the ambient air around the cigarette butt in the butt receiving compartment of the disposable cigarette butt receiving bag is minimized, and therefore the glow of the cigarette butt will extinguish immediately when the cigarette butt is introduced into the disposable cigarette butt receiving bag.

The above-mentioned objective problems are also solved by a method of manufacturing a disposable cigarette butt receiving bag according to claim 11. With such a method of manufacturing a disposable cigarette butt receiving bag a cost effective handling of a large number of disposed cigarette butts is achieved due to the cost effective manufacturing of a disposable cigarette butt receiving bag.

Further specific features of the invention are disclosed in the dependent claims.

BRIEF DESCRIPTION OF THE DRAWINGS

Further advantages and features of the invention can be derived from the following detailed description of exemplary embodiments of the invention, with reference to the drawings.

DETAILED DESCRIPTION

Figure 1:
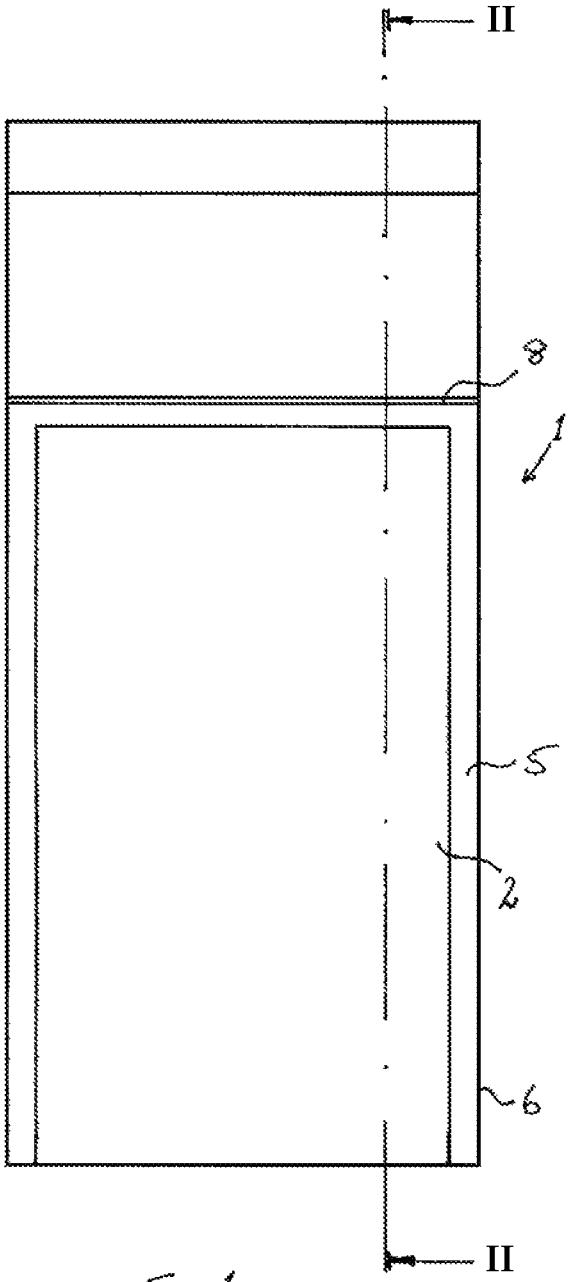
FIG. 1 shows a front view of a disposable cigarette butt receiving bag according to the present invention.
Figure 2:
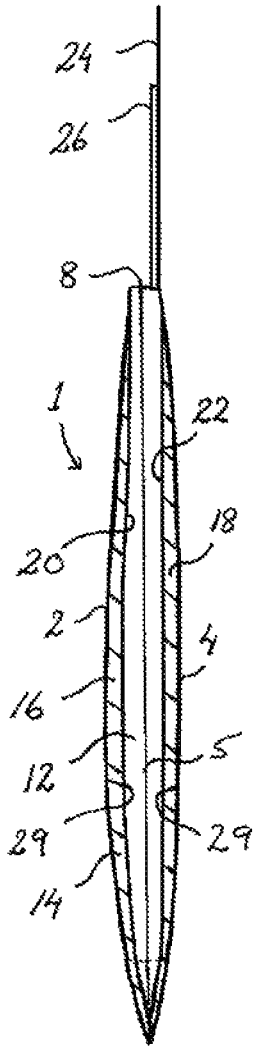
FIG. 2 shows a cross section view along line II-II in FIG. 1.

FIGS. 1 and 2 show a disposable cigarette butt receiving bag 1 of disposable type for receiving and extinguishing glowing cigarettes. The bag 1 comprises a forward sheet 2 and a rearward sheet 4, which sheets are sealed by a seal 5 to each other along their outer edges 6 leaving an edge portion unsealed so as to provide an opening 8 for receiving a cigarette butt 10. A cigarette butt receiving compartment 12 is formed between said forward and rearward sheets 2, 4. A fluid 14 is disposed in two heat insulating volumes 16, 18 within the cigarette butt receiving compartment 12. A first heat insulating volume 16 is delimited by the forward sheet 2 and a forward inner layer material 20 which is sealed against the forward sheet 2.

A second heat insulating volume 18 is delimited by the rearward sheet 4 and a rearward inner layer material 22 which is sealed against the rearward sheet 4.

Figure 3:
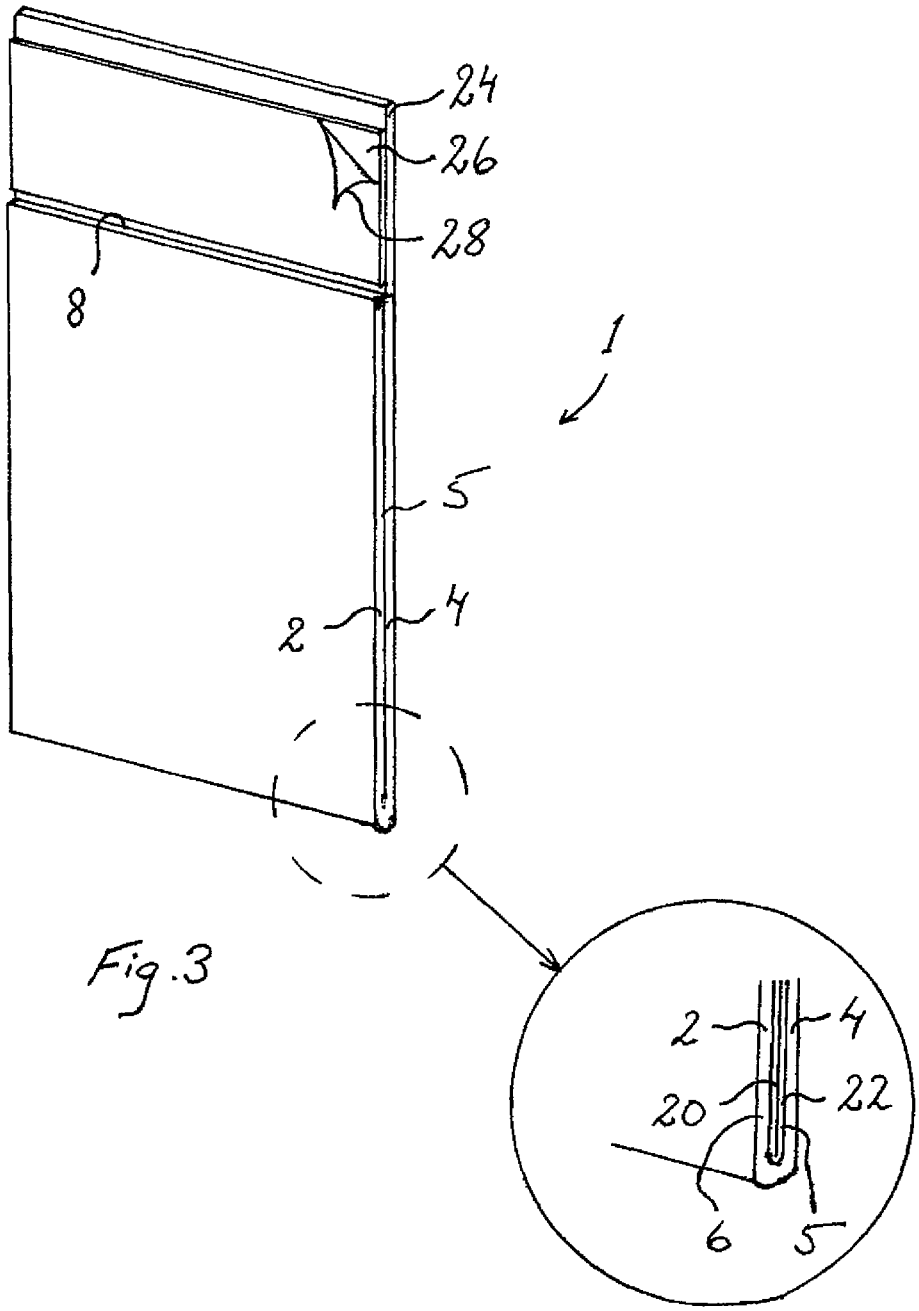
FIG. 3 shows a view in perspective of a disposable cigarette butt receiving bag according to the present invention.
Figure 4:
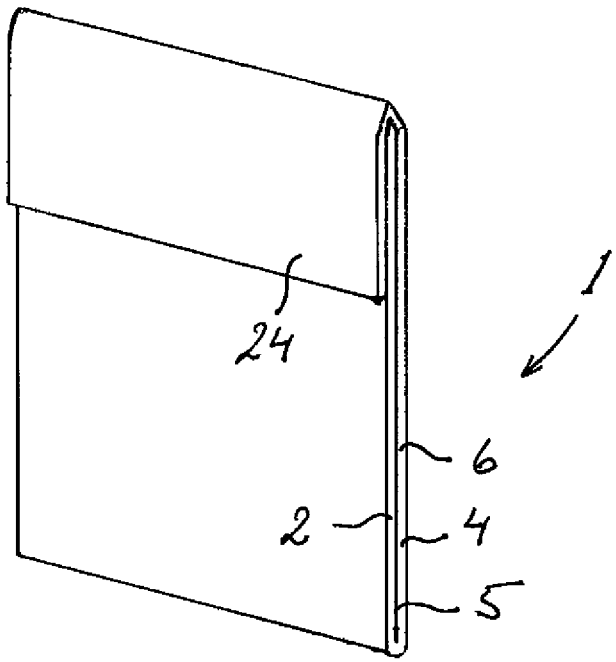
FIG. 4 shows a view in perspective of a disposable cigarette butt receiving bag according to the present invention.

FIGS. 3 and 4 show the cigarette butt receiving bag 1 according to the present invention in perspective views. One of the forward or rearward sheets 2, 4 is provided with a foldable closure flap 24 extending from the edge of the opening 8. In FIGS. 3 and 4 the rearward sheet 4 is provided with the foldable closure flap 24. A pressure sensitive adhesive 26 is arranged along the entire width of the flap 24 to ensure tight sealing of the bag 1 when the closure flap 24 is folded down onto the outside of the opposite sheet. Preferably, the adhesive 26 is a permanent pressure sensitive adhesive 26 for permanent closure of the bag 1, so that the closed bag 1 will be made more child proof, animal proof and a hindrance of chemical leakage. A pressure-sensitive adhesive 26 allows the user to easily seal the bag 1 by folding the closure flap 24 onto one side of the bag 1 and applying a light pressure. However, either a removable or a permanent pressure-sensitive adhesive 26 may be used.

A permanent pressure-sensitive adhesive 26, which can exhibit high adhesion values and support kilograms of weigh per square centimetre of contact area, can be used in order to provide an improved child proof and animal proof bag 1. In this case, a protective release liner 28 is placed over the adhesive 26 area of the closure flap 24. The bag 1 may be delivered with the closure flap 24 folded in an open position, or with the closure flap 24 folded in a closed position. Upon usage, the user opens the bag 1 opening 8 by pressing the sides of the bag 1 towards each other, places the item to be disposed off inside the bag 1, removes the release liner 28, puts it in the bag 1 and folds the closure flap 24 over. When the closure flap 24, being provided with the permanent pressure-sensitive adhesive 26, is pressed onto the side of the bag 1 the adhesive 26 cures. Thereafter, the closure flap 24 cannot be opened without considerable effort and/or by the use off tools such as a knife or scissors. Thus, assuming that relatively tear proof material is used for the bag 1 and the closure flap 24, the obtained bag 1 will be made more child proof and animal proof.

A removable pressure sensitive adhesive 26, which is designed to form a temporary bond, entails the advantage that no release liner 28 is needed and that the bag 1 may be delivered in a compact closed condition. Upon usage, the user opens the bag 1 by unfolding the closure flap 24 against the action of the removable adhesive 26. When the cigarette butt 10 has been placed into the bag 1, the closure flap 24 is reclosed.

A part of FIG. 3 is enlarged in order to clearly indicate how the forward sheet 2, rearward sheet 4, forward inner layer material 20 and rearward inner layer material 22 are sealed to each other along their outer edges 6.

According to a preferred embodiment the fluid 14 is an aqueous heat insulating liquid solution which is free-flowing in the heat insulating volumes 16, 18. The aqueous heat insulating liquid solution comprises water, a consistency agent and a preserving agent. The consistency agent is preferably xanthan, the preserving agent is preferably a mixture of sodium benzoate and potassium sorbate. Other consistency agents and preserving agents may also be used.

The forward and rearward sheets 2, 4 are preferably made of a laminate, comprising paper on which metalized polyester film 29, such as an aluminium polyester film, is arranged and wherein the forward and rearward inner layer materials 20, 22 are made of polyethylene.

Figure 5:
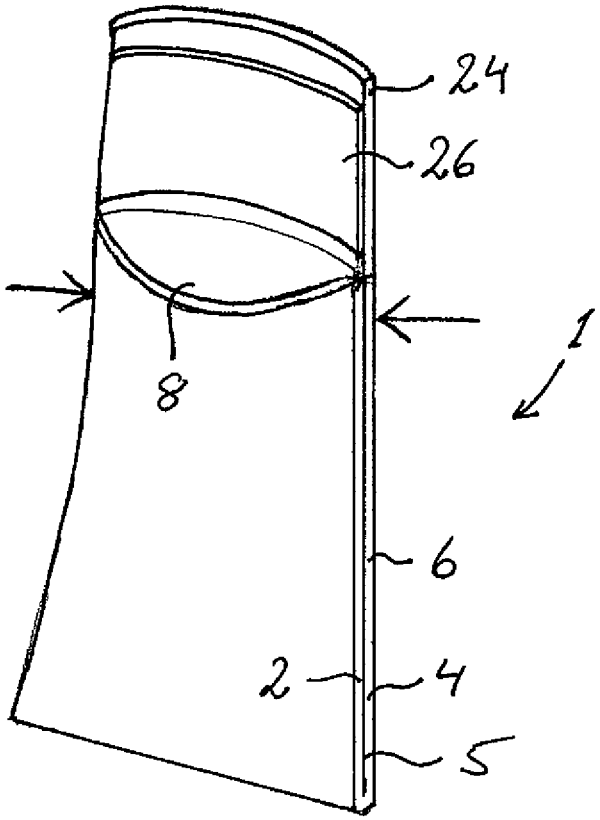
FIG. 5 shows a view in perspective of a disposable cigarette butt receiving bag according to the present invention.
Figure 6:
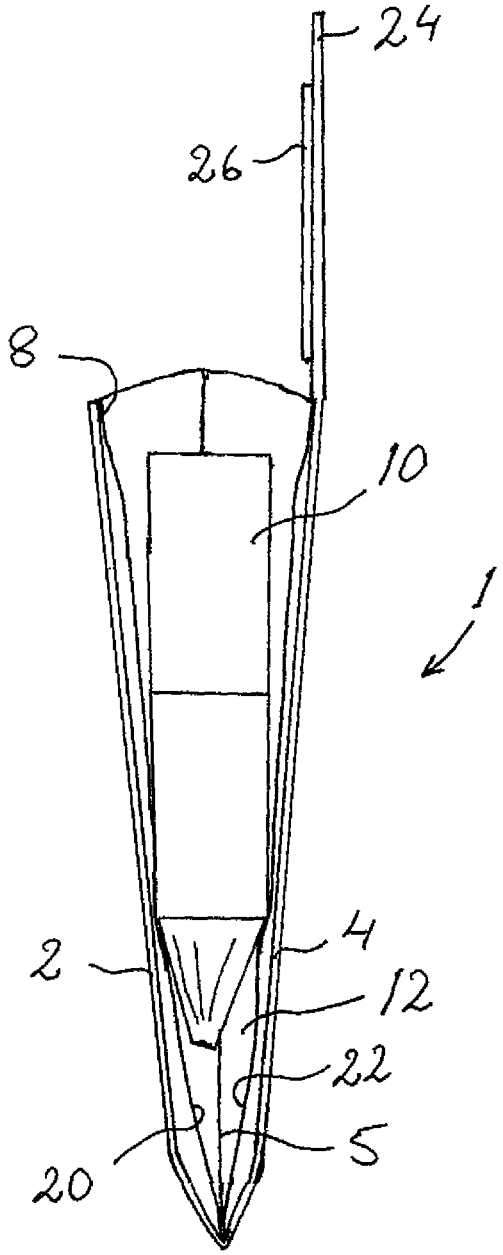
FIG. 6 shows a cross section view along line II-II in FIG. 1 with a cigarette butt introduced into the disposable cigarette butt receiving bag.
Figure 7:
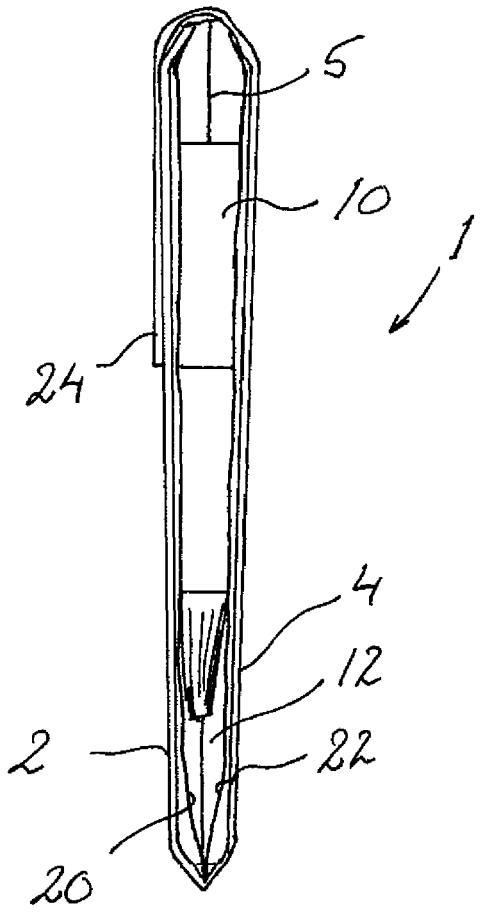
FIG. 7 shows a cross section view along line II-II in FIG. 1 with a cigarette butt introduced into the disposable cigarette butt receiving bag and the closure flap folded into a closed position of the bag.

FIG. 5 shows the disposable cigarette butt receiving bag 1 according to the present invention in a perspective view. Upon usage, the user opens the bag 1 opening 8 by pressing the sides of the bag 1 towards each other, which is indicated by arrows in FIG. 5. When pressing the sides of the bag 1 towards each other the opening 8 will be large enough to receive a cigarette butt 10. FIG. 6 discloses a cross section of the disposable cigarette butt receiving bag 1 along line II-II in FIG. 1. A cigarette butt 10 has been placed inside the cigarette butt receiving compartment 12 of the bag 1. FIG. 7 discloses a cross section of the disposable cigarette butt receiving bag 1 along line II-II in FIG. 1. In FIG. 7 the user released the pressure on the sides of the bag 1 so that a clamping or self-closing action of the forward and rearward sheets 2, 4 is obtained. Finally, the user removes the release liner 28, puts it in the bag 1 and folds the closure flap 24 over.

The relationship of the bag 1 width and the rigidity of the forward and rearward sheets 2, 4 are preferably chosen so that the above-mentioned clamping or self-closing action is obtained. This clamping or self-closing action is enhanced if the forward and rearward sheets 2, 4 are arranged flat onto each other in the seal area, and if the seals 5 have a width so that said sheets are rigidly attached to each other along the seals 5 in a fixed-end manner. Said clamping or self-closing action contributes to the effective extinguishing of the cigarette butt 10.

The width of the forward inner layer material 20 and the width of the rearward inner layer material 22 between two longitudinal edges of the respective forward and rearward inner layer material 20, 22 together substantially correspond to a circumference of the cigarette butt 10. This will increase safety to fire due to disposed glowing cigarette butts 10, since the ambient air around the cigarette butt 10 in the butt receiving compartment 12 of the disposable cigarette butt receiving bag 1 is minimized, and therefore the glow of the cigarette butt 10 will extinguish immediately when the cigarette butt 10 is introduced into the disposable cigarette butt receiving bag 1. As a precautionary measure the fluid 14 will be exposed to the cigarette butt 10 if the glow burns trough the forward or rearward inner material 20, 22. The fluid 14 will then extinguish the glow. Therefore, the fluid 14 act as an additional safety element in extinguishing the glow.

The disposable cigarette butt receiving bag 1 is arranged as a disposable article for single use and which should be disposed of as combustable litter after use. Because of the fluid 14 disposed in the insulating volumes 16, 18, the bag 1 is fireproof, so that it can receive a glowing cigarette butt 10 and can be thrown away in a refuse bin without setting things on fire. The bag 1 is also heat-insulating, so that the outside of the bag 1 is not heated by a glowing cigarette butt 10 within the bag 1. Therefore, a person will not be injured by the bag 1.

Figure 8:
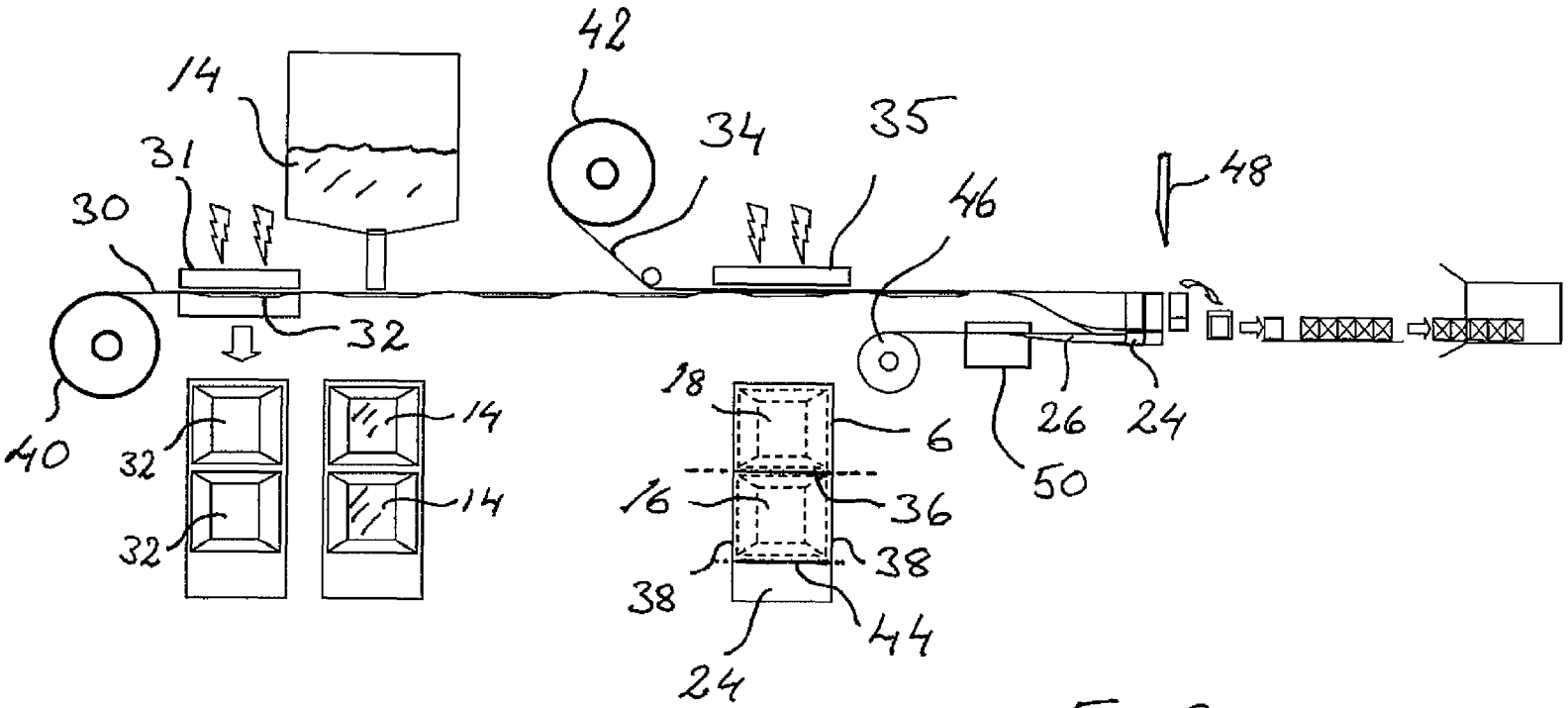
FIG. 8 shows a method of manufacturing a disposable cigarette butt receiving bag according to the present invention.

FIG. 8 shows a method of manufacturing the above-mentioned disposable cigarette butt receiving bag 1 of the present invention. The method comprises the steps of providing a flexible plastic layer material 30, forming cavities 32 in the flexible plastic layer material 30 in a thermoforming station 31, filling the cavities 32 with a fluid 14, providing a laminate 34, comprising paper on which metalized polyester film 29 is arranged, seal the paper laminate 34 to the flexible plastic layer material 30, in a thermo sealing station 35, along outer edges 6 of the cavities 32 to form heat insulating volumes 16, 18 filled with the fluid 14, folding the flexible plastic layer material 30 and the paper laminate 34 so that the paper laminate 34 constitutes forward and rearward sheets 2, 4, and the flexible plastic layer material 30 constitutes forward and rearward inner layer materials 20, 22, whereby the flexible plastic layer material 30 is clamped in the fold 36 between the forward and rearward sheets 2, 4, and finally sealing the forward and rearward sheets 2, 4, and thereby the intermediate forward and rearward inner layer materials 20, 22, to each other along two lines 38 that are essentially perpendicular to the fold 36. It is also possible to apply a seal along the fold 36.

Preferably the flexible plastic layer material 30 and the paper laminate 34 are provided from a respective roll 40, 42, which means that the final manufacturing step before packaging of the bags 1 is cutting the forward and rearward sheets 2, 4, and thereby the intermediate forward and rearward inner layer materials 20, 22 along the lines 38 that are essentially perpendicular to the fold 36. A cutter mechanism 48 is provided for the cutting operation.

The folding of the flexible plastic layer material 30 and the paper laminate 34 may be performed off-centre, leaving additional layer material on the forward or rearward sheets 2, 4, which material constitutes a foldable closure flap 24 for the bag 1. It is also possible to creasing the forward or rearward sheets 2, 4 along a line, so that a crease line 44 ensuring tight sealing of the bag 1, when the closure flap 24 is folded, is formed. A pressure sensitive adhesive 26 is arranged along the entire width of the closure flap 24 to ensure tight sealing of the bag 1 when the closure flap 24 is folded. In a hot melt aggregate 50 the adhesive 26 is applied on the protective release liner 28, which is provided from a roll 46. Thereafter the protective release liner 28 is applied to the closure flap 24.

As mentioned above, the disposable cigarette butt receiving bag 1 according to the present invention is of disposable type and prevents pollution of the environment due to cigarette butts 10 thrown on the ground. The butt receiving bag 1 is easy to keep and store into a pocket or a handbag and after the butt 10 has been introduced into the butt receiving bag 1 it may be disposed into a refuse bin or put back into the pocket or the handbag and disposed later.

The invention claimed is:

1. A cigarette butt receiving bag of disposable type for receiving and extinguishing glowing cigarettes, which bag comprises a forward sheet, a rearward sheet, wherein the sheets are sealed to each other along their outer edges leaving an edge portion unsealed so as to provide an opening for receiving a cigarette butt, thereby forming a cigarette butt receiving compartment between said forward and rearward sheets, and comprising a fluid, which is disposed in two heat insulating volumes within the cigarette butt receiving compartment, wherein:

a first heat insulating volume is delimited by the forward sheet and a forward inner layer material which is sealed against the forward sheet, and a second heat insulating volume is delimited by the rearward sheet and a rearward inner layer material which is sealed against the rearward sheet.

2. A cigarette butt receiving bag according to claim 1, wherein the relationship of the bag width and the rigidity of the forward and rearward sheets is chosen so that a clamping or self-closing action is obtained.

3. A cigarette butt receiving bag according to claim 1, wherein the forward and rearward sheets are arranged flat onto each other in the seal area, and wherein the seals have a width so that said sheets are rigidly attached to each other along the seals in a fixed-end manner, whereby a clamping or self-closing action is obtained.

4. A cigarette butt receiving bag according to claim 1, wherein one of the forward and rearward sheets is provided with a foldable closure flap extending from the edge of the opening, and where a pressure sensitive adhesive is arranged along the entire width of the flap to ensure tight sealing of the bag.

5. A cigarette butt receiving bag according to claim 4, wherein the adhesive is a permanent pressure sensitive adhesive for permanent closure of the bag, whereby the closed bag will be made more child proof and animal proof.

6. A cigarette butt receiving bag according to claim 1, wherein the fluid is an aqueous heat insulating liquid solution which is free-flowing in the heat insulating volumes.

7. A cigarette butt receiving bag according to claim 6, wherein the aqueous heat insulating liquid solution comprises water, a consistency agent and a preserving agent.

8. A cigarette butt receiving bag according to claim 7, wherein the consistency agent is xanthan, the preserving agent is a mixture of sodium benzoate and potassium sorbate.

9. A cigarette butt receiving bag according claim 1, wherein the forward and rearward sheets are made of a laminate, comprising paper on which metalized polyester film is arranged and wherein the forward and rearward inner layer materials are made of polyethylene.

10. A cigarette butt receiving bag according to claim 1, wherein the width of the forward inner layer material and the width of the rearward inner layer material between two longitudinal edges of the respective forward and rearward inner layer material together substantially correspond to a circumference of the cigarette butt.

11. A method of manufacturing a cigarette butt receiving bag of disposable type for receiving and extinguishing glowing cigarettes, the method comprising the steps of, providing a flexible plastic layer material, forming cavities in the flexible plastic layer material, filling the cavities with a fluid, providing a laminate, comprising paper on which metalized polyester film is arranged, sealing the paper laminate to the flexible plastic layer material along outer edges of the cavities to form heat insulating volumes filled with the fluid, folding the flexible plastic layer material and the paper laminate so that the paper laminate constitutes forward and rearward sheets, and the flexible plastic layer material constitutes forward and rearward inner layer materials, whereby the flexible plastic layer material is clamped in the fold between the forward and rearward sheets, and sealing the forward and rearward sheets, and thereby the intermediate forward and rearward inner layer materials, to each other along two lines that are essentially perpendicular to the fold.

12. A method according to claim 11, further comprising the steps of providing the flexible plastic layer material and the paper laminate from a respective roll, and cutting the forward and rearward sheets, and thereby the intermediate forward and rearward inner layer materials along the lines that are essentially perpendicular to the fold.

13. A method according to claim 11, wherein the folding of the flexible plastic layer material and the paper laminate is performed off-centre, leaving additional layer material on the forward or rearward sheets, which material can constitute a foldable closure flap for the bag.

14. A method according to claim 13, further comprising a step of creasing the forward or rearward sheets along a line, so that a crease line ensuring tight sealing of the bag, when the closure flap is folded, is formed.

15. A method according to claim 13, further comprising a step of arranging a pressure sensitive adhesive along the entire width of the closure flap to ensure tight sealing of the bag when the closure flap is folded.

* * * * *